US007451547B1

(12) United States Patent
Lantinen

(10) Patent No.: US 7,451,547 B1
(45) Date of Patent: Nov. 18, 2008

(54) POOL DECK MASONRY SCRIBE

(76) Inventor: Thomas Lantinen, 1603 NW. 202 St., Newberry, FL (US) 32669

( * ) Notice: Subject to any disclaimer, the term of this patent is extended or adjusted under 35 U.S.C. 154(b) by 0 days.

(21) Appl. No.: 11/800,011

(22) Filed: May 4, 2007

(51) Int. Cl.
*B43L 13/02* (2006.01)
*B25H 7/04* (2006.01)

(52) U.S. Cl. ..... 33/42; 33/32.2

(58) Field of Classification Search ..... 33/1 G, 33/1 H, 18.1, 32.2, 32.3, 36, 41.6, 42, 43, 33/44; 401/193
See application file for complete search history.

(56) References Cited

U.S. PATENT DOCUMENTS

| | | | | | |
|---|---|---|---|---|---|
| 390,403 | A | * | 10/1888 | Sanborn | 33/42 |
| 561,585 | A | * | 6/1896 | Harris | 33/41.4 |
| 1,195,886 | A | * | 8/1916 | Wheeler | 33/42 |
| 1,594,482 | A | * | 8/1926 | Wentz et al. | 33/44 |
| 1,792,393 | A | * | 2/1931 | Phillips | 33/42 |
| 2,200,975 | A | * | 5/1940 | Anderson | 33/32.3 |
| 2,305,065 | A | * | 12/1942 | Corkish | 33/42 |
| 2,660,791 | A | * | 12/1953 | Howell et al. | 33/41.6 |
| 2,936,470 | A | * | 5/1960 | Meeds | 33/42 |
| 2,947,084 | A | * | 8/1960 | Billings | 33/32.2 |
| 3,286,351 | A | * | 11/1966 | McAlister | 33/42 |
| 3,885,315 | A | * | 5/1975 | Polselli et al. | 33/42 |
| 4,934,058 | A | * | 6/1990 | Gibson | 33/42 |
| 5,862,601 | A | * | 1/1999 | O'Brien et al. | 33/42 |
| 6,935,037 | B1 | | 8/2005 | Garcia | |
| 7,021,860 | B1 | * | 4/2006 | Bolstad | 404/94 |
| 7,114,261 | B1 | | 10/2006 | Osborne et al. | |

* cited by examiner

*Primary Examiner*—R. A. Smith
(74) *Attorney, Agent, or Firm*—Sven W. Hanson

(57) ABSTRACT

A marking device or scribe for marking masonry pieces on a horizontal deck area surrounding a pool, sauna or similar below-ground construction. The device is designed for use during construction of deck areas to enable defining a border or margin a constant distance from a curved vertical edge. This marking facilitates subsequent cutting of the marked masonry pieces for removal and construction of a more aesthetic edge border. Device guide wheels follow curved vertical walls of the pool and guide a frame and attached marker that is supported on wheels on the deck. The marking device is biased against the masonry pieces to create a path line mark as the frame and guide wheels are manually move along the edge.

8 Claims, 4 Drawing Sheets

POOL DECK MASONRY SCRIBE

BACKGROUND OF THE INVENTION

The present invention pertains to devices and methods for marking and cutting paving blocks, bricks and similar masonry construction materials. In particular, the invention addresses a problem in construction of horizontal masonry surfaces surrounding swimming pools. Such areas are most typically referred to as pool "decks" and are most typically formed of poured imperious materials such as concrete, or of preformed masonry pieces set in mortar or similar hardenable adhesives.

Many modern swimming pools, whirlpools, wadding pools, and similar constructions such as emersion saunas are designed in many various arbitrary shapes having rounded vertical walls without straight sides or hard corners. Forming decks surrounding these pool designs using conventional masonry pieces that are primarily square or rectangular in shape requires sculpting each masonry piece that intersects the curved pool vertical wall. In just constructions, it is common to finish the masonry deck with a narrow border at the deck edge, adjacent the pool edge and walls. This still requires that each masonry piece at the outside edge of the border be sculpted to match the pool edge outline—although offset from the edge. In the past, each masonry piece adjacent the border was individually hand cut to fit this outline—a time and talent intensive job. Often, using prior methods, consecutive masonry pieces are not perfectly cut to match each other resulting in a jagged and unsightly border line. What is needed is a simple and efficient device and method of marking and cutting horizontally multiple placed masonry pieces along a line following a curved or straight vertical wall edge.

SUMMARY OF THE INVENTION

The present invention is a masonry marking device with a primary function and enablement of generating a continuous curved line on masonry pieces laid adjacent curved pool walls. The line is formed parallel to the pool wall to enable easy continuous cutting of multiple masonry pieces by following the marked line with a cutting device such as a powered circular saw. The present inventive device includes multiple guide wheels mounted, with vertical axes, on a frame and configured to follow complex curves of the vertical walls of a rounded shaped swimming pool and the like. The frame connects the guide wheels to multiple support wheels to enable the support wheels to roll on a generally horizontal deck surface adjacent and above the vertical pool walls. The guide wheels and support wheels are mounted and configured to ensure that the frame may be easily maintained, by a user, in a constant perpendicular orientation with respect to the vertical wall. A marker, such as a pencil or construction marker is mounted on the frame between the support wheels and guide wheels to enable the marker to be applied to the deck surface adjacent the edge of the pool wall. The support wheels are mounted on the frame and oriented to allow rotation of the frame about a vertical axis with a minimum of transverse slip of the wheels. One or more secondary stabilizing wheels are located between the support wheels and the guide wheels. A handle is connected to the frame to allow the frame to be manually moved along the vertical wall. The frame includes a mechanism to adjust the relative location of the mark.

In operation, the frame is moved along a deck area surrounding a pool wall, as a user applies force to the handle to ensure the guide wheels remain in contact with the wall, to cause the marker to draw a line on the deck parallel to the vertical wall.

Preferably, the frame includes a conventional bubble sight level mounted to be monitored by a user and configured to indicate proper vertical positioning of the guide wheels and the marking device. To accommodate irregularities in the horizontal surface, the marking device is spring mounted in an angled "trailing arm" configuration.

The present invention is intended to be used prior to cutting the masonry pieces so marked. The masonry pieces may then be removed from the deck area in preparation for forming a replacement deck border portion. This may consist of new masonry pieces. Other uses of the inventive device are contemplated. Additional novel aspects and benefits of the invention will be discerned from the following description of particular embodiments and the accompanying figures.

DETAILED DESCRIPTION OF THE INVENTION

Figure 1:
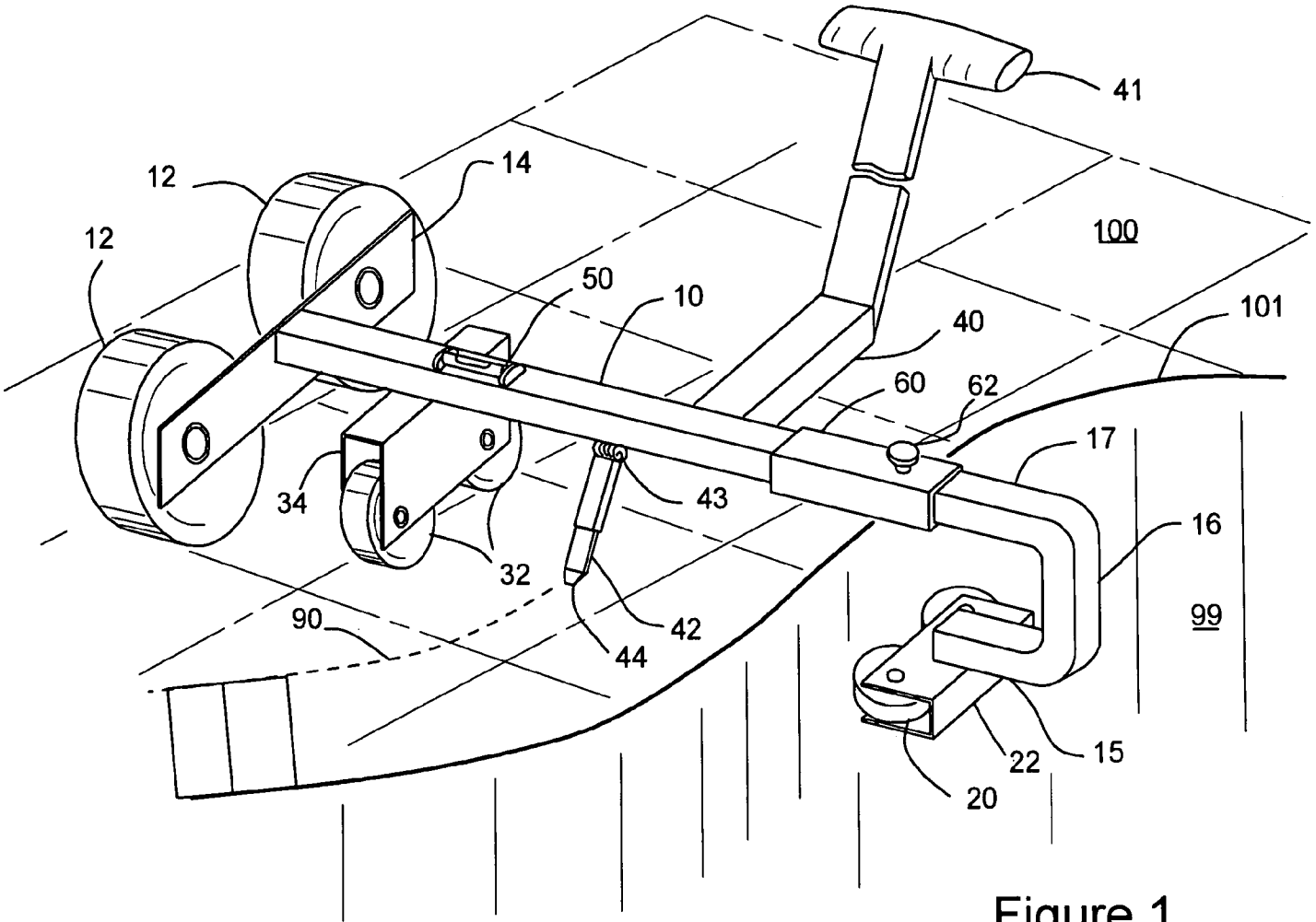
FIG. 1 is a perspective view illustration of a preferred embodiment of the invention on a typical working surface.
Figure 2:
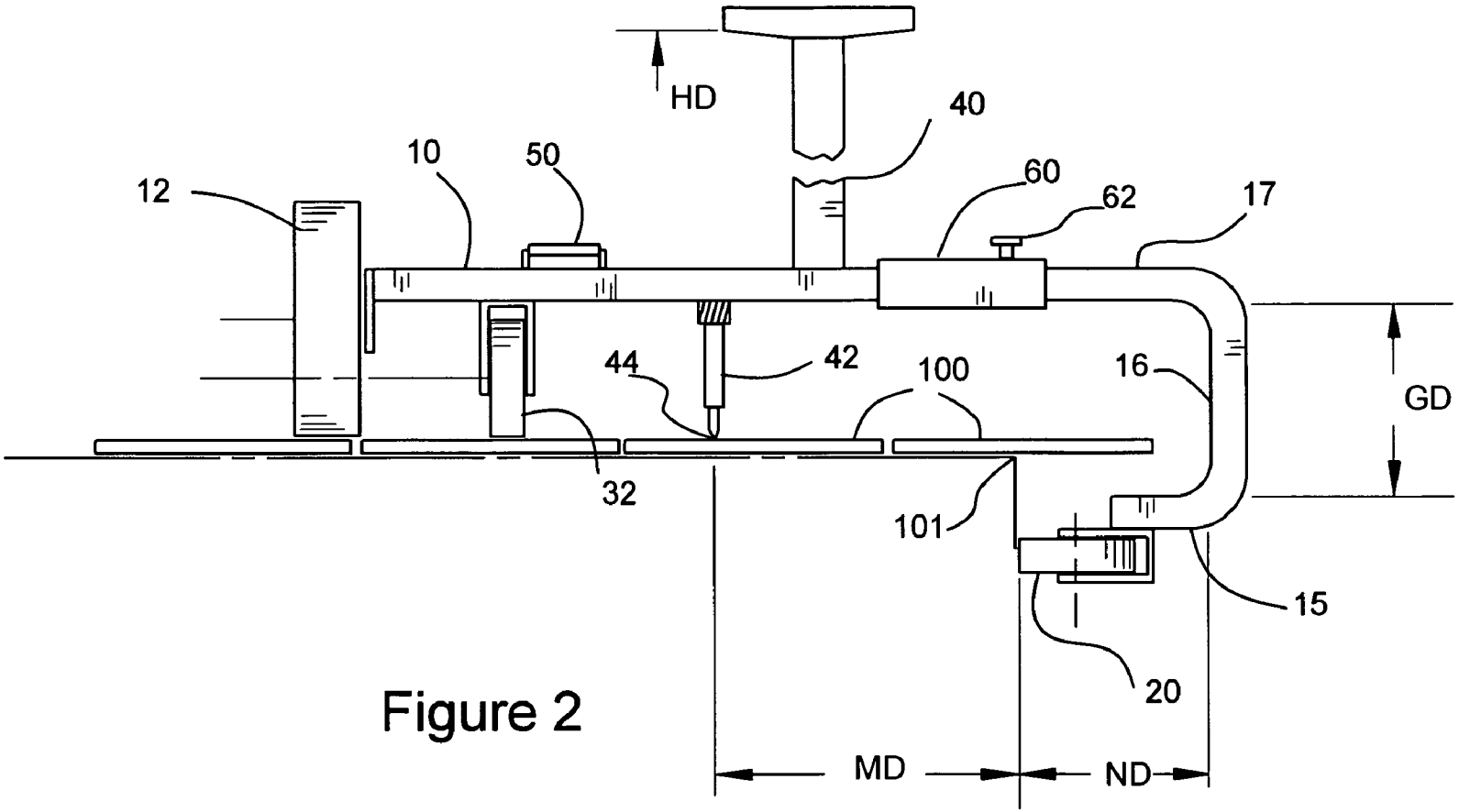
FIG. 2 is a side view of the embodiment of FIG. 1.
Figure 3:
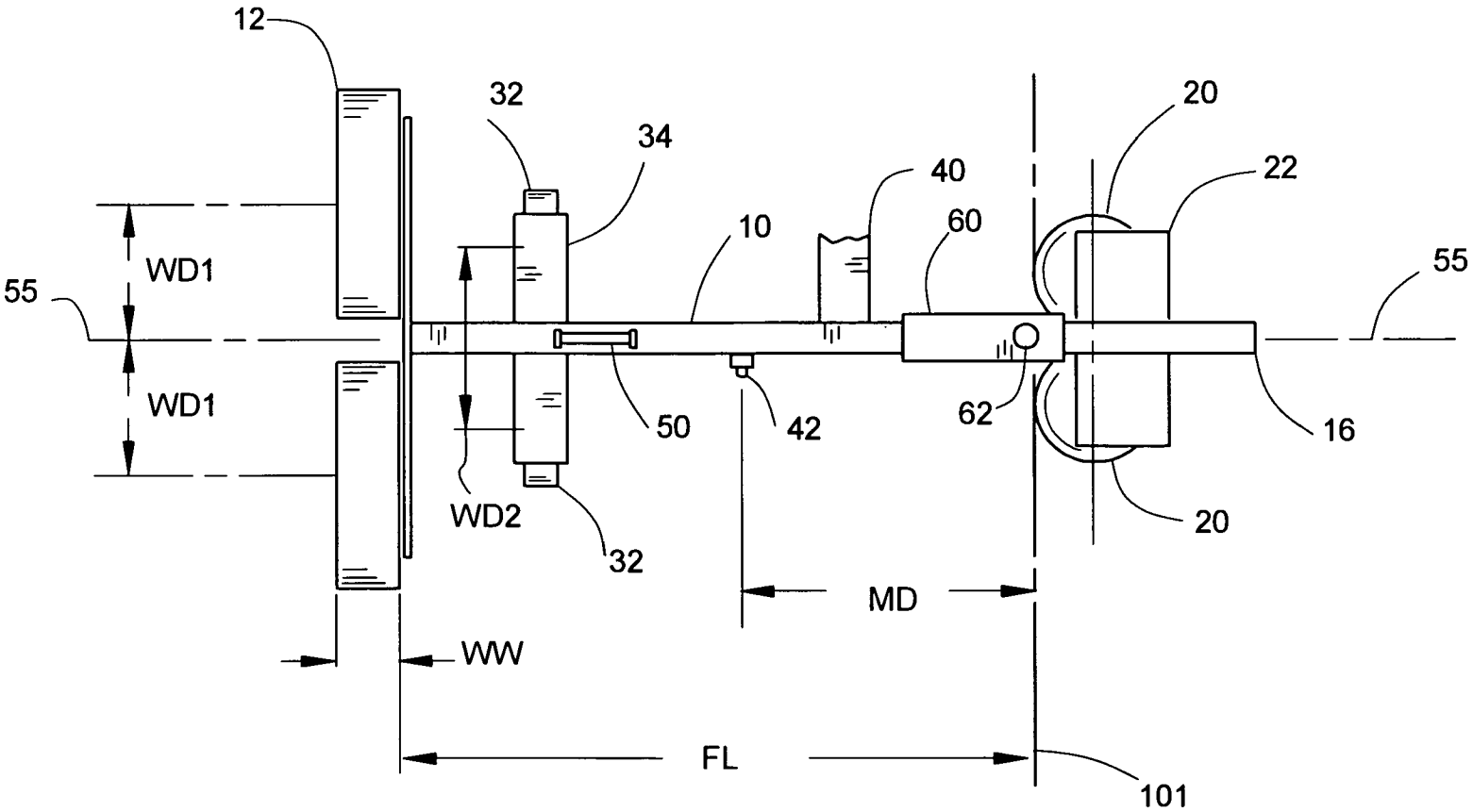
FIG. 3 is a top plan view of the embodiment of FIG. 1.

FIGS. 1, 2, and 3 regard a preferred embodiment of the invention. The following discussion regards all these figures. The inventive device includes a rigid frame 10 that functions to support, connect, and orient the operational elements. The construction of the frame shown is one of many alternatives, and the particular construction and elements used in the frame are not critical so long as the frame provides effectively the same support, connectivity and orientation of the operational elements.

In this construction, the frame 10 consists primarily of a simple elongated steel main frame element. At one end of the frame 10 are secured two support wheels 12. The support wheels 12 are rigidly mounted to the frame 10, with their axes of rotation mutually parallel. The support wheels 12 are mounted via a first steel support bracket 14 that is welded to the frame 10, although the particular device for mounting the support wheels 14 to the frame 10 is not critical.

At an end of the frame 10 opposite the support wheels 12, the frame includes a vertical offset in the form of a U-shaped neck portion 16. The details of the neck portion are provided below. At the lower, offset, end 15 of the neck portion 16 are mounted two guide wheels 20. The guide wheels 20 are mounted via a second steel support bracket 22 welded to the frame 10. Here too, the particular construction of the device used to mount the guide wheels 20 to the frame 10 is not critical. Two guide wheels are provided to enable a user to more easily maintain proper orientation of the frame 10 in use.

Between the support wheels 12 and the guide wheels 20, two secondary support wheels 32 are mounted to the frame 10 via a welded steel third support bracket 34. The secondary wheels 32 are oriented with their axes of rotation mutually parallel, and also parallel to the axes of the support wheels 12. The secondary wheels 32 are preferably smaller in diameter than the support wheels 12, but are mounted lower on the frame 10 such that the respective contact areas of all the wheels fall on a single common plane.

Between the secondary wheels 32 and the guide wheels 20, a handle 40 extends perpendicularly out and upward from the frame 10. The handle 40 terminates in a grip 41 configured for comfortable handling by a user. The grip 41 must be located at a height to allow operation by a standing user, preferably at a height dimension HD located 24 to 36 inches above the bottom of the support wheels 12 (from the contact plane). The handle 40 and grip 41 provide a means for manually directing and moving the frame 10. Various alternative geometries and constructions of the handle 40 are contemplated and other variations are possible without deviating from the essential function and operation of the handle and invention.

Between the handle 40 and the secondary wheels 32 is mounted a marker 42 that extends generally downward from the frame 10. The location of the marker between the support wheels and the guide wheels is important to enable forming path lines close to a pool edge. The marker 42 extends preferably slightly transversely from the frame 10, inclined in a direction opposite the anticipated and selected relative direction of travel of the device. The marker 42 is mounted to the frame via a spring 43 or similar mechanisms for biasing the marker 42 downward against a horizontal working surface on the contact plane. The spring 43 assists in maintaining marker contact on uneven surfaces. The marker 42 may be any of a variety of devices including a "lead" construction pencil, a chalk, or an ink marker or other marker appropriate for hard and rough surfaces such as brick and other masonry.

The relative location of the marker 42 and the support wheels 12 and secondary wheels 32 is important. It is greatly desired to be capable of marking a deck area very close to the edge 101, to prepare to form borders of only a few inches width for example. The marker 42 must be located, for such use, within a few inches, horizontally, from the guide wheels 20. At the same time, it is common to have gaps in the masonry pieces previously laid adjacent the edge 101 (those to be cut and at least partially removed). These gaps make impossible smooth support and operation of the support wheels 12 and secondary wheels 32 adjacent the edge 101. To satisfy these constraints, all wheels supported on the horizontal surface must be outside the marker—more distant from the edge and guide wheels 20.

In typical operation of the invention, the support wheels 12 and secondary wheels 32 rest on, and are supported on, a horizontal deck area formed of masonry pieces 100 surrounding the edge 101 of a swimming pool. The frame 10 is oriented to position the guide wheels 20 evenly against the vertical wall 99 of the pool with the frame 10 generally perpendicular to the edge 101 and wall 99. The marker 42 contacts and is biased against the deck area. The relative spacing of the marker 42 from the guide wheels 20 determines the path of the marker 42 and the resulting line mark 90 produced on the masonry pieces.

To scribe or mark a line for cutting of the masonry pieces on the deck area, the user grasps the handle 40 and moves the frame parallel to the pool edge 101. As the frame 10 moves, the marker 42 travels a continuous path parallel to, and evenly spaced from, the pool edge 101. To maintain the frame 10 perpendicular to the curve of the pool edge 101, and therefore the guide 20 wheels even on the pool wall 99, the user must provide transverse forces to the handle 40 as well.

Although the support wheels 12 and secondary wheels 32 establish the angle of the frame 10 with respect to the horizontal, a bubble level 50 is preferably provided mounted on an upper surface of the frame 10, within view of a user in normal operation position. The bubble level 50 should indicate normal level when the support wheels 12 and secondary wheels 32 are properly contacting the horizontal surface (which may, or might not be, horizontal). This is a benefit due to the close distancing of the support wheels 12 and secondary wheels 32, and their greater distance from the guide wheels, which may induce unbalancing.

In operation of the inventive device around a curved pool wall 99, the frame must rotate about a vertical axis. At any curve of the pool wall, this results in the support wheels following a curved path. This curved path may have a varying radius of curvature. Due to the fixed orientation of the support wheels' axes, this movement of the wheels requires relative transverse slipping of the wheels on the contact surface. The amount of support wheel slip is dependent on, at least, the distance between the support wheels 12 and the guide wheels 20, and the distance and angle between the axes of rotation of the support wheels and the guide wheels' centerline 55. To enable smooth operation of the marker, without intermittent jumping of the support wheels 12, this wheel slip must be minimized. For with reason, the wheel space dimension WD1 between each support wheel axis of rotation and the guide wheel centerline 55 should be no more than six inches. Preferably, the support wheels are located symmetrically on both sides of the centerline 55. Similarly, the secondary wheels 32 have a wheel interspacing dimension WD2 of no more than six inches, and are located preferably symmetrically about the centerline 55. The centerline 55 is defined as the horizontal line perpendicular to a line passing through the vertical axes of both guide wheels 20 and equally spaced between the two guide wheels. Hence, the centerline 55 will be perpendicular to the pool wall when the guide wheels are both properly in contact with the vertical wall 99.

Also to limit intermittent jumping of the wheels during slip, the wheels size, both diameter and width, should not be large. Preferably, the support wheel diameter is in the range of four to eight inches. Smaller support wheels are not effective in providing a stable support for the frame on the uneven surface of spaced masonry. Larger support wheels induce potentially undesirable large slip forces due to larger contact surface area, and also the inherently larger clearance spacing of larger wheels. The width dimension WW of the support wheels 12 should be no greater than two inches. The diameter of the secondary wheels 32 may be smaller as they are not relied on for stability of the frame. The secondary wheels 32 preferably have a diameter in the range of two to three inches. The guide wheels 20 preferably have an outside diameter of about two to three inches, with a six inch inter-wheel spacing.

For the same reason as above, the support wheels 12 should not be formed of materials that stick or have a high friction coefficient that would increase slip forces. Hard solid or pneumatic rubber or hard plastic wheel materials are suggested. An acceptable secondary wheel 32 and guide wheel 20 may be provided by conventional wheels used on "in-line" recreational skates.

The frame neck portion 16 is provided to accommodate the inevitable overhanging masonry pieces at the edge 101. When setting relatively large masonry, to completely cover the deck area, it is necessary to set pieces overhanging the pool edge 101 as seen in FIG. 2. The frame neck portion is configured to extend past the maximum overhang dimension of most conventional masonry, and then return to provide support for the guide wheels 20. Consequently, the neck portion 16 has a generally horizontal upper portion 17 and lower portion 15 separated by an intervening vertical gap. The vertical gap dimension GD, between the two portions of the neck, is preferably in the range of five to six inches to provide sufficient clearance and ensure contact on an uninterrupted portion of the pool vertical wall 99. The effective horizontal depth dimension ND of the neck portion, from the inside of the vertical neck portion 16, parallel to the centerline 55, to the distal most surface of the guide wheels 20 should be in the range of six to twelve inches to accommodate typical masonry.

It is desirable to provide for adjustment of the horizontal dimension between the marker 42 and the guide wheels 20. This dimension determines the relative location of the path line 90 with respect to the edge 101. For this purpose, the frame 10 includes a slide collar 60 with a threaded locking bolt 62. The frame is formed of two pieces, the offset neck portion 16 separable from the remainder and joined by insertion into the slide collar 60. The offset neck 16 may be partially slid in or out of the slide collar 60 until the desired marker dimension is reached, and the locking bolt 62 then tightened to lock onto the offset neck 16. Most preferably, the marker 42 has a horizontal location dimension MD, parallel the centerline 55, from the most distal surface of the guide wheels 20 (touching the wall 99) toward the support wheels 12, in the range of one to twenty inches to enable marking path lines accommodating the most desired border constructions. The marker location dimension MD should be adjustable at least over a range of three to twelve inches to accommodate the most typical border designs.

Alternatively, adjustment of the marker 42 may be provided by other constructions, including multiple mounting points, a frame mounted slidable base, or other means for adjusting the marker location relative to the frame 10. In these alternative configurations, the slide collar 60 and alteration of the frame and placement of the guide wheels 20 is unnecessary.

The above described adjustment using the slide collar 60 also alters the overall length of the frame 10 and its horizontal frame length dimension FL, between the guide wheels 20 and support wheels 12 (FIG. 3).

The lower, distal, end 44 of the marker 42 should be coincident with or close to the guide wheel centerline 55—preferably within two inches of the centerline 55. If the marker is located too far from the centerline 55, rotation of the frame 10 as it is moved along a curved wall will result in the marker 42 deviating from the desired path.

In alternative configurations, only one secondary wheel may alternatively be used while maintaining the relative geometries defined above. The stability of the frame will suffer somewhat, but function similarly.

Figure 4:
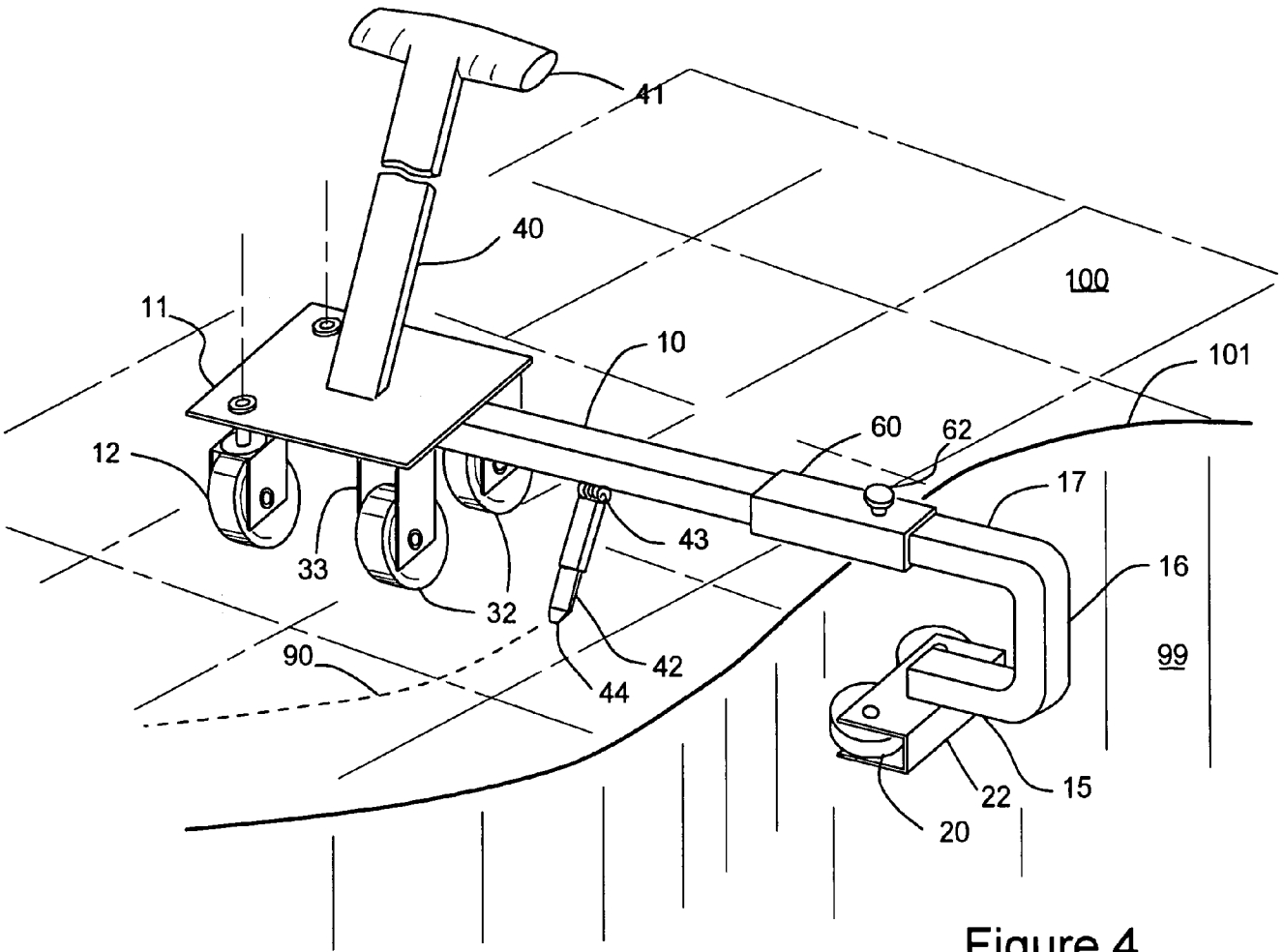
FIG. 4 is a perspective view of an alternative configuration of the invention.

FIG. 4 illustrates an alternative embodiment incorporating "caster" style support wheels. In the figure, each of the two support wheels 12 are connected to the frame 10 by a device providing rotation about a vertical wheel axis. A slight horizontal offset of the wheel 12 from this vertical axis is preferred to provide the typical characteristics of a caster wheel as is conventionally used on furniture such as office chairs. The rotation of the support wheels 12 about a vertical axis allows smooth travel of the frame when the guide wheels (20—see FIG. 1) traverse rounded walls as discussed above. The secondary wheels 32 should be uncastered to ensure stable travel and a smooth scribed line 90. Due to their castering, the support wheels 12 in this configuration may be smaller in size than previously described, with a preferred outside diameter in the range of two to three inches.

The location and spacing of both the support wheels 12 and the secondary wheels 32 are as discussed previously. As the support wheels' 12 horizontal axes of rotation are not fixed, the wheel location should be measured as the perpendicular distance from the guide wheel centerline 55. In the figure, the wheels are mounted to the frame 10 via a rigid platform 11 that is integral to the frame (the platform obscures viewing the second support wheel which is located and positioned in like manner symmetrically with respect to the platform and centerline 55). The secondary wheels 32 are mounted via rigid brackets 33. The platform 11 provides a convenient structure to attach the handle 40. This placement is also beneficial to movement and control of the support wheels 12. Although not shown in this figure, use of a level as discussed above is beneficial for the same purposes.

The preceding discussion is provided for example only. Other variations of the claimed inventive concepts will be obvious to those skilled in the art. For example, a conventional powered circular saw may be mounted on the frame in the place of the marker, with the same relative geometry, to allow immediate cutting along the path line to enable removal of the cut masonry without marking. Adaptation or incorporation of known alternative devices and materials, present and future is also contemplated. The intended scope of the invention is defined by the following claims.

The invention claimed is:

1. A device for marking a line on horizontal surface surrounding and following a curved perimeter edge of a swimming pool, the device comprising:

two guide wheels having a common horizontal plane and having respective vertical axes of rotation; a horizontal centerline passing between the guide wheels;

two support wheels having respective horizontal rotation axes located on opposite sides of the guide wheel horizontal centerline;

two secondary wheels having respective secondary horizontal rotation axes located on opposite sides of the guide wheel horizontal centerline;

a rigid frame having a first end and a second end;

the support wheels secured to the first end;

the second end having a downwardly extending neck portion; the guide wheels secured to the neck portion;

the secondary wheels secured to the frame between the guide wheels and the support wheels such that the secondary wheels and the support wheels have a common contact plane;

a rigid handle extending generally upward from the frame to a grip configured to be grasped by a user standing on the contact plane;

a marker extending downward from the frame, and having a horizontal marker distance dimension from the guide wheels;

an adjustment means for altering the marker dimension over the range of three to twelve inches;

a biasing means for biasing the marker against a horizontal surface on the contact plane;

such that the support wheels and secondary wheels may be placed on a horizontal working surface while maintaining the guide wheels in contact with a vertical wall below the support wheels and between the support wheels and the guide wheels, while the marker is biased against the working surface.

2. A device, according to claim 1, and wherein:

the neck portion has a vertical clearance length, above the guide wheels, in the range of 5 to 6 inches.

3. A device, according to claim 1, and wherein:

the guide wheels have a horizontal neck depth dimension, parallel to the centerline, from the neck portion to the most distal surface of the guide wheels, in the range of six to twelve inches.

4. A device, according to claim 1, and wherein:

the support wheels each have a outside diameter in the range of 4 to 8 inches.

5. A device, according to claim 4, and wherein:

the support wheels axes are spaced apart a distance of no more than 12 inches.

6. A device, according to claim 1, and wherein:

the guide wheels each have an outside diameter in the range of 2 to 3 inches.

7. A device, according to claim 1, and wherein:

the grip is located a height dimension in the range of 24 to 36 inches above the contact plane.

8. A device for marking a line on horizontal surface surrounding and following a curved perimeter edge of a swimming pool, the device comprising:

two guide wheels having respective vertical axes of rotation; a horizontal centerline passing between the guide wheels;

two support wheels located on opposite sides of the guide wheel horizontal centerline, each support wheel rotatable about a respective horizontal axis;

two secondary wheels having respective secondary horizontal rotation axes located on opposite sides of the guide wheel horizontal centerline;

a rigid frame having a first end and a second end;

the support wheels secured to the first end;

the second end having a downwardly extending neck portion; the guide wheels secured to the neck portion;

the secondary wheels secured to the frame between the guide wheels and the support wheels such that the secondary wheels and the support wheels have a common contact plane;

a rigid handle extending generally upward from the frame, between the support wheels and the secondary wheels, to a grip configured to be grasped by a user standing on the contact plane;

a marker extending downward from the frame, and having a horizontal marker distance dimension from the guide wheels;

an adjustment means for altering the marker dimension;

a biasing means for biasing the marker against a horizontal surface on the contact plane;

such that the support wheels and secondary wheels may be placed on a horizontal working surface while maintaining the guide wheels in contact with a vertical wall below the support wheels and between the support wheels and the guide wheels, while the marker is biased against the working surface.

* * * * *